United States Patent [19]

Lasier et al.

[11] 4,040,144

[45] Aug. 9, 1977

[54] DOOR ASSISTER

[75] Inventors: Thomas R. Lasier; Raymond H. Schnarr, both of Princeton, Ill.

[73] Assignee: Schlage Lock Company, San Francisco, Calif.

[21] Appl. No.: 689,103

[22] Filed: May 24, 1976

[51] Int. Cl.[2] ..... E05F 3/00

[52] U.S. Cl. ..... 16/66; 16/DIG. 7; 16/DIG. 21; 49/32; 49/137; 49/386

[58] Field of Search ..... 16/49, 59, 66, 69, 70, 16/62, DIG. 7, DIG. 21, 128 R, 137; 49/340, 137, 265, 273, 274, 341, 386, 32

[56] References Cited

U.S. PATENT DOCUMENTS

| | | | |
|---|---|---|---|
| 2,276,338 | 3/1942 | Potter et al. | 49/137 |
| 2,298,542 | 10/1942 | Potter et al. | 49/137 |
| 2,586,442 | 2/1952 | Seagren | 49/137 |
| 2,618,365 | 11/1952 | Seagren | 49/137 X |
| 3,010,433 | 11/1961 | Codling | 16/66 X |
| 3,220,046 | 11/1965 | Flint | 16/59 |
| 3,369,323 | 2/1968 | Millard et al. | 49/137 |
| 3,872,541 | 3/1975 | Peterson | 16/137 |

FOREIGN PATENT DOCUMENTS

| | | | |
|---|---|---|---|
| 2,213,314 | 3/1972 | Germany | 49/340 |
| 824,722 | 12/1959 | United Kingdom | 49/137 |

*Primary Examiner*—Werner H. Schroeder
*Assistant Examiner*—Moshe I. Cohen
*Attorney, Agent, or Firm*—Lothrop & West

[57] ABSTRACT

A typical door closer has a cylinder in which a piston reciprocates to compress a spring. An assistor for such a closer has a cylindrical shell fastened to one end of and continuing the cylinder. The shell has a barrier wall at one end adjacent the cylinder, a partition wall dividing the shell into a booser compartment and a main compartment, and a head wall at the other end. Air under regulated pressure is supplied to the main compartment, wherein the air presses a main plunger tube, extending through the partition wall, against a booster plunger having a rod extending through the barrier wall and abutting the piston. A port in the plunger tube receives air from the main compartment through the tube. In some plunger tube positions the port is blocked by the partition wall and in other plunger tube positions opens into the first compartment. A check valve when open allows air flow from the booster compartment to the main compartment. Air under regulated pressure is supplied to the main plunger throughout the whole piston stroke and is supplied to the booster plunger during only part of the piston stroke. The applied air pressure is regulated to be slightly less than an amount necessary to compress the spring and move the door unaided.

7 Claims, 4 Drawing Figures

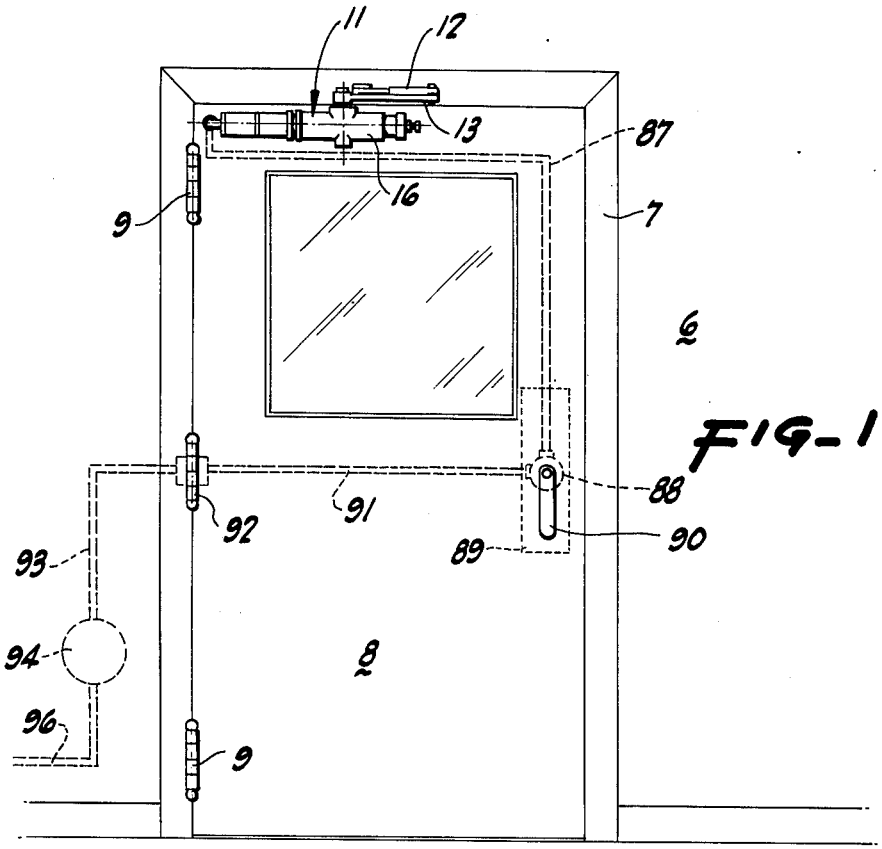
FIG-1
FIG-4
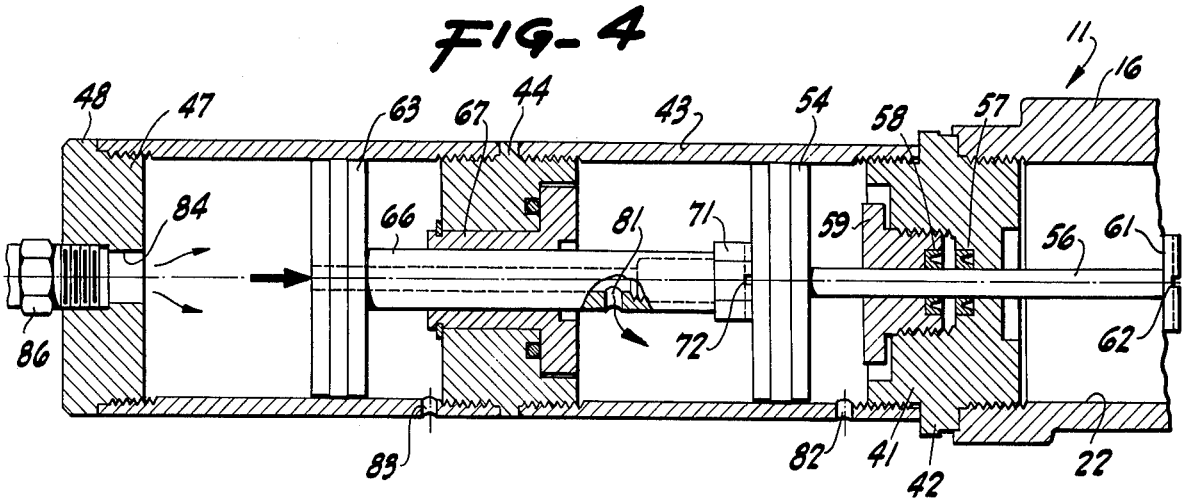

DOOR ASSISTER

BRIEF SUMMARY OF THE INVENTION

The assister is designed to afford fluid force to augment the user's force in pushing or pulling a door open. The assister force is not sufficient to make the door open under fluid power alone. The assister applies a varying amount of force depending upon the position of the assister in overcoming the door closer spring.

For many years it has been customary to provide various doors, particularly large public doors, with spring-actuated closers to make certain that the door panels are in closed position except when momentarily being opened by a user. It is often the case that the amount of physical force required to make the door panel open is more than many people like to exert. In some instances the force is more than many handicapped people can exert at all, so that the door panel cannot be opened by them. This may be merely an inconvenience, but often it may present a substantial hazard. While the door panel opening resistance is not necessarily the same from time to time due to wind pressure and comparable factors, there is always a minimum resistance due to the closer spring. Furthermore, this spring resistance, although predetermined, increases as the spring moves from a relatively relaxed position toward a relatively compressed position. Thus, while a door panel can be cracked open initially, it may be increasingly difficult to open it fully. This likewise presents its own hazard.

There are many servo devices or power mechanisms available for use with door panels. These are ordinarily quite expensive to provide and to install as well as to maintain, and the expense often makes it impracticable to utilize them.

It is therefore an object of the invention to provide an assister for a door closer which is economical to make and install since it can be applied directly to an existing closer.

Another object of the invention is to provide an assister which furnishes enough force so that even a handicapped person can open a door panel provided with it, but which is not so strong as to overcome the closer spring completely and so remove the door panel opening resistance entirely.

A further object of the invention is to provide an assister which can easily be operated by anyone without prior instruction and without the necessity for getting acquainted with the particular character of door opening operation.

Another object of the invention is to provide an assister which takes into account the varying resistance of the customary closer spring.

Another object of the invention is to provide an assister which does not interfere at all with the customary closing movement of the door panel under the influence of the customary door closer.

A further object of the invention is to provide an assister which can readily be installed in various different environments.

Another object of the invention is in general to provide an improved door closer assister.

Other objects together with the foregoing are attained in the embodiment of the invention described in the accompanying description and illustrated in the accompanying drawings.

BRIEF DESCRIPTION OF THE SEVERAL VIEWS OF THE DRAWING

FIG. 1 is an elevation of a room wall showing a door frame on which is mounted a hinged door panel equipped with a door closer augmented by the assister of the present invention.

FIG. 4 is a view comparable to FIG. 3 showing the assister in an advanced position.

DETAILED DESCRIPTION

Figure 2:
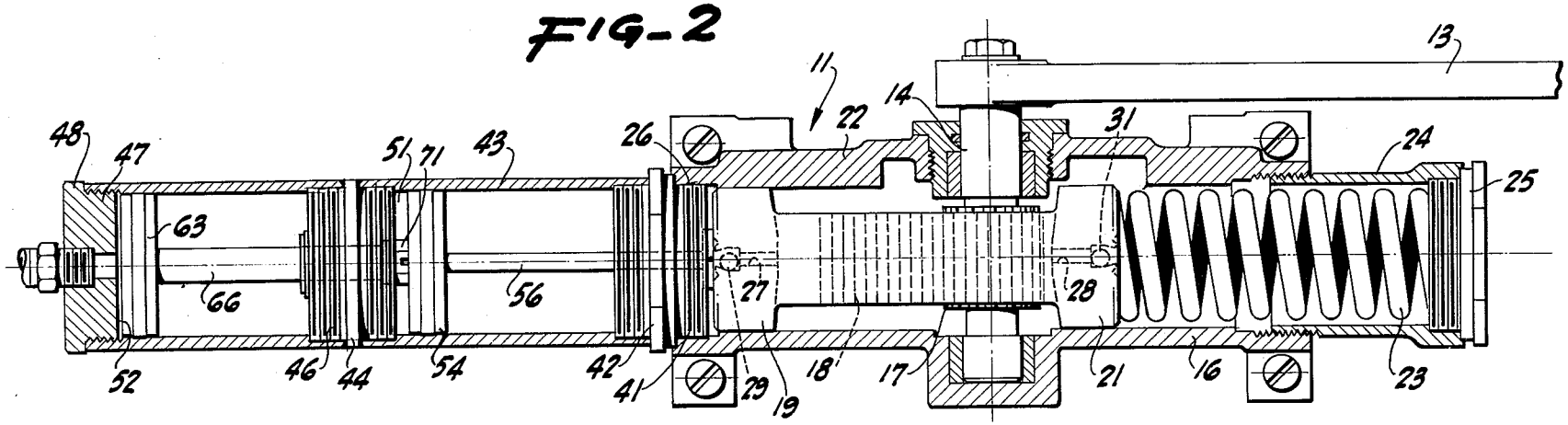
FIG. 2 is a cross-section on an axial vertical plane through the closer and assister shown in FIG. 1, various portions being broken away to reduce the size of the Figure.

While the assister pursuant to the invention can be installed in widely variant locations and under many different circumstances, it has with success been installed as indicated in FIG. 1 herein. In a wall 6 there is mounted the customary door frame 7 on which is mounted a door panel 8. The panel has hinges 9 so that the panel swings toward the viewer about the hinge axis. Interconnecting the frame and the door panel is a door closer 11 of the customary sort having a pair of links 12 and 13 joined to the frame 7 in the customary way. As shown particularly in FIG. 2, the closer is of the sort shown in Flint U.S. Pat. No. 3,220,046 issued Nov. 30,1965 and assigned to the assignee hereof.

The link 13 is at one end of a shaft 14 (FIG. 2) journalled in the casing 16 of the closer and is arranged so that the shaft 14 is rotated when the door panel moves on its hinges with respect to the frame, all in the customary way. Movement of the shaft 14 causes rotation of a pinion 17 in mesh with a rack 18 intermediate and joined to piston heads 19 and 21. The pistons and rack reciprocate within a cylinder 22 formed in the casing. The piston 21 abuts against a compression spring 23 disposed in an extension 24 and seated against a screwed-in head 25 closing one end of the casing.

The piston head 19 customarily operates adjacent a plug (not shown) like the head 25 and normally carried in screw threads 26 at the outboard end of the casing. When so closed and in standard condition, the casing is largely filled with oil, which flows through passages 27 and 28 in the pistons under the control of check valves 29 and 31 and also flows through additional passages and valves in the casing. These are not illustrated herein, but are set out fully in the above-mentioned patent. The patent mechanism incorporates a delay feature that retards the beginning of door closing. This, in itself, is of help to handicapped persons.

In the normal operation of this closer, when the shaft 14 is rotated in door opening direction, the spring is compressed as the door is opened. When the open door is released, the force of the spring closes the door and restores the piston mechanism to its original location at a rate or rates controlled by the flow of oil through the oil passages. Customarily, there is sufficient residual force in the spring when the door is near closed position so as to make certain that the panel shuts and also that the resistance of any hardware on the door, such as a spring-latch bolt, is overcome and the door is firmly latched shut. During opening, the spring is compressed from its minimum amount toward its maximum amount, and the resistance substantially increases as the door panel is opened. While the spring design force or resistance and the hydraulic damping may vary a great deal from one closer to another, the normal operation is substantially as described.

Pursuant to the present invention, the customary closer, as described, is altered by removing the standard plug from the left end, as seen in FIG. 2, of the casing 16 and substituting for such plug a threaded barrier wall 41. In some respects the barrier wall is like the removed plug and includes a flange 42 adapted to receive a wrench so that the barrier wall 41 can be screwed tightly into position and so substantially closes the end of the casing 16. The barrier wall is extended beyond the flange 42 and is threaded to receive a cylindrical shell 43. Intermediate its ends, the shell is threadedly connected to abut a flange 44 of an intermediate partition wall 46. The cylindrical shell 43 continues and at its outboard end is internally threaded to receive a head wall 47 having a wrench flange 48 thereon, so that the head wall can be secured tightly in position. The cylindrical shell 43 is in alignment with the cylinder 22 and in effect continues the casing 16.

The partition wall 46 divides the interior of the shell 43 into a booster compartment 51 and a main compartment 52 of equal diameter. Adapted to reciprocate within the shell 43 is a booster plunger 54 including a plunger rod 56 passing through the barrier wall 41 and extending into the cylinder 22. A pair of packing washers 57 and 58 preclude leakage along the rod 56. Access to the washers is gained by removing a packing carrier 59. The end of the plunger rod 56 within the cylinder 22 is provided with an enlargement 61 having cross channels 62 cut therein, so that the enlargement can suitably abut the head of the piston 19, the channels 62 allowing free egress from and around the check valve 29, so that the closer mechanism fluid can flow precisely as before.

Between the partition wall 46 and the head wall 47 there is provided a main plunger 63 having a threaded connection 64 to a plunger tube 66. Surrounding the tube 66 and disposed in the partition wall 46 is a bearing bushing 67 sealed against leakage and removably retained by a clip.

The end of the plunger tube 66 is provided with a threaded connection 68 receiving a sleeve 69 within the interior of the tube. The sleeve is enlarged to form a head 71 with cross passages 72 therein. A passageway 73 extends entirely through the sleeve and head and accommodates a check valve 74 urged closed toward the end of the passageway by a spring 76. The ball check 74 controls unidirectional flow through the passageway 73 extending through the tube 66 between the booster compartment 51 and the main compartment 52.

The plunger tube 66 also has a radial port 81. This is positioned between the ends of the plunger as to lie within the bushing 67 when the plunger 63 is near the left end of its travel and to advance out of the bushing and to open into the booster compartment 51 when the plunger 63 is translated toward the right in FIG. 4.

Between the booster plunger 54 and the barrier wall 41 is a vent port 82 affording permanent communication between the interior of the shell at that point and the atmosphere, while another vent port 83 is disposed in the shell between the main plunger 63 and the intermediate partition wall 46, so that the volume between those parts is always open to the atmosphere.

The head wall 47 has a passage 84 therein connected by a fitting 86 and appropriate tubing 87 to a control valve 88 on the door panel 8, as shown in FIG. 1. The control valve 88 is of any suitable sort having a connection to a push panel 89 mounted on the far side of the door panel opposite the hinges 9, as shown by dotted lines in FIG. 1. There may also be a similarly connected pull hook 90 on the near side of the door panel. From the valve 88 there is a tube 91 connected to a special hinge 92 having a continuous air passage therethough no matter what the pivoted position of the hinge might be. From the hinge another tube 93 goes through a pressure regulator 94 of any standard sort to an additional tube 96 leading to a source of air under pressure. While air is referred to, another fluid such as oil or a different gas may readily be employed.

When the air pressure system is not connected or when the valve 88 is open to the atmosphere, the operation of the door panel 8 is exactly as it was prior to the installation of the assister. That is, a person swinging the door 8 open moves the piston 21 to compress the spring 23, and when the door is released the spring is effective to swing the door panel closed again. When the mechanism is fully hooked up and the air pressure regulator 94 is appropriately set, a person utilizing the mechanism presses against the actuating panel 89 on the far side of the door or pulls on the hook 90. The valve 88 is so actuated to supply air at a selected pressure from the regulator 94 through the hinge 92 and tubes 91 and 87, as well as the fitting 86, to the assister.

Figure 3:
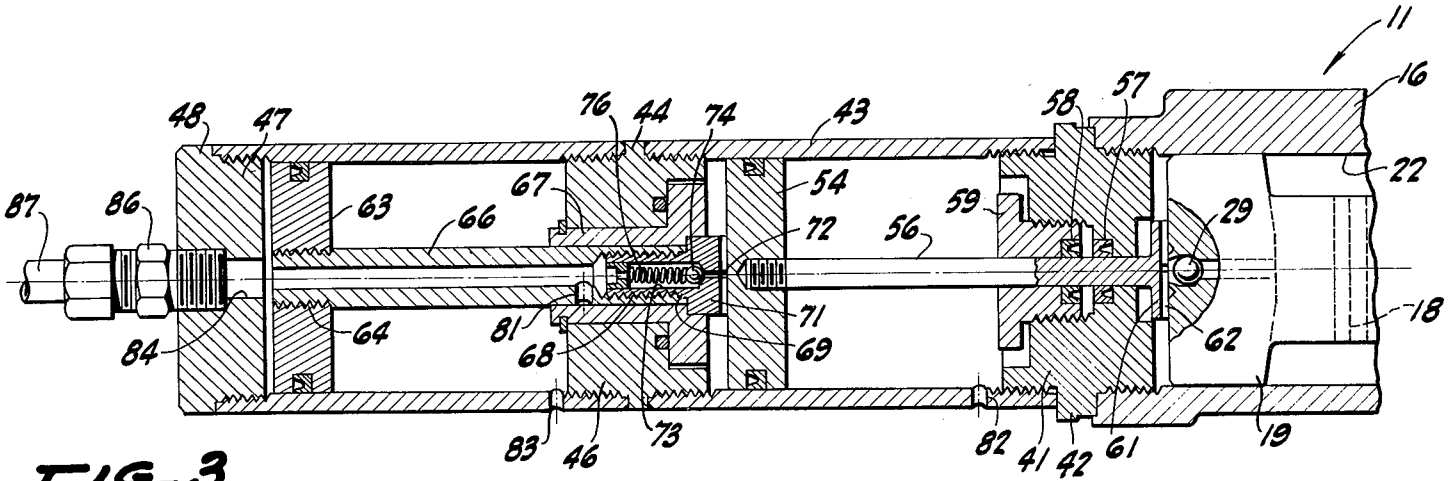
FIG. 3 is a view comparable to FIG. 2 but showing in cross-section on an axial vertical plane and to an enlarged scale the interior construction of the assister itself.

Air entering the main compartment 52 cannot escape through the center of the plunger tube 66 because the check valve 74 is closed and cannot escape from the port 81 since the port is within the bushing 67 and blanked off. Consequently, the main chamber 52 is pressurized to the value permitted by the regulator 94 and tends to move the main plunger 63 toward the right in FIG. 3. Since the head 71 is in close abutment with the booster plunger 54, that plunger likewise tends to move toward the right. The plunger rod 56 is initially in abutment with the piston 19, so that mechanism tends to move to the right also. However, the air pressure is set at a value just under the amount necessary to cause motion. The extra force needed is supplied by the user through the plate 89 or the hook 90. While this extra force is very low, the user thus retains complete control. Forces from the user and from the compressed air together are effective to compress the spring and to open the door panel, but with only a little manual force, the air mechanism serving as an assisting device or as a partial servo device.

When the main plunger 63 has moved a predetermined amount, the force required to compress the spring 23 has increased, perhaps enough to dismay the user. But that amount of motion is sufficient, as shown in FIG. 4, to move the port 81 out of the bushing 67 and to open the port to the booster compartment 51. The booster compartment is then pressurized in addition to the main compartment 52. Force toward open position of the door is thus augmented by the extra air pressure area of the booster plunger 54. Since the port 81 comes out of the bushing gradually, there is not an abrupt increase in opening force, but rather a gradual increase. Also, the size and shape of the port 81 are carefully chosen so that there is a gradual, controlled increase in the servo opening force. Even so, the total opening force from both plungers is always less than an amount entirely to overcome the more or less compressed spring. The combination of manual pressure and smoothly stepped air pressure assistance makes the door panel open easily and completely and under user control.

When the panel has swung open sufficiently, the user removes his hand from the push panel 89, or the pull hook 90. This permits the valve 88 to return to its initial position and reconnects the tubing 87 to the atmosphere. The main compartment 52 immediately exhausts, and the booster compartment 51 exhausts its superatmospheric pressure by unseating the check valve 74 against the spring 76 to discharge through the passageway 73 and through the plunger tube 66 to the atmosphere. The opening force on the plungers is diminished to zero and the spring 23 restores all of the parts to initial position. Motion of the plungers is free because the ports 82 and 83 allow only atmospheric pressure on their opposite faces. During working motion to the right in FIG. 3, the booster plunger 54 may draw a small vacuum in the booster compartment 51 until the port 81 opens and supplies pressure air, but the retarding force due to the vacuum is so small as to be immaterial.

What is claimed is:

1. A door assister for a door closer having a cylinder with a piston movable in a predetermined direction therein against a resistance for door opening movement comprising a cylindrical shell, means for securing said shell to one end of said cylinder as a continutation thereof, a booster plunger movable in said shell in said predetermined direction and adapted to abut said piston, means cooperating with said shell for defining a booster compartment partially bounded by said booster plunger, a main plunger movable in said shell in said predetermined direction and adapted to abut said booster plunger, means cooperating with said shell for defining a main compartment partially bounded by said main plunger, and means for supplying said booster compartment and said main compartment with fluid under pressure insufficient to move said piston against all of said resistance.

2. A door assister as in claim 1 including means for operating said supplying means in sequence to said booster compartment and said main compartment.

3. A door assister as in claim 1 in which said resistance varies with different door positions between closed position and open position and said means for supplying fluid to said booster compartment and said main compartment supplies fluid thereto under pressure insufficient to overcome said resistance in any of said positions.

4. A door assister for a door closer having a cylinder with a piston movable therein and a spring in said cylinder opposing movement of said piston toward door open position, a cylindrical shell, means for securing said shell to one end of said cylinder as a continuation thereof, a partition wall dividing said shell into a booster compartment and a main compartment, a barrier wall separating said booster compartment from said cylinder, a head wall substantially closing said main compartment, a booster plunger in said booster compartment including a plunger rod extending through said barrier wall toward said piston, a main plunger in said main compartment including a plunger tube extending through said parition wall toward said booster plunger, said plunger tube at one end opening into said main compartment and near the other end having a port movable with said tube between one position within said partition wall and another position open to said booster compartment, and means for supplying fluid under pressure to said main compartment.

5. A door assister as in claim 4 including means defining a fluid passageway between said booster compartment and said main compartment, and a check valve in said passageway opening for flow from said booster compartment to said main compartment.

6. A door assister as in claim 4 including an atmospheric vent in said shell between said booster plunger and said barrier wall and another atmospheric vent in said shell between said main plunger and said partition wall.

7. A door assister as in claim 4 in which pressure fluid in said main compartment acts in a direction tending to compress said spring during the entire stroke of said piston and pressure fluid in said booster compartment acts in a direction to compress said spring during only a portion of the stroke of said piston.

* * * * *